United States Patent [19]

Bahr et al.

[11] 4,275,847

[45] Jun. 30, 1981

[54] PROCESS FOR THE TREATMENT OF ALUMINUM-SALT SLAGS

[75] Inventors: Albert Bahr, Daniel-Flach-Str. 3, 3392 Clausthal-Zellerfeld, Fed. Rep. of Germany; Joachim Kues, Göttingen, Fed. Rep. of Germany

[73] Assignee: Albert Bahr, Clausthal-Zellerfeld, Fed. Rep. of Germany

[21] Appl. No.: 55,189

[22] Filed: Jul. 2, 1979

[30] Foreign Application Priority Data

Jul. 12, 1978 [DE] Fed. Rep. of Germany ..... 2830574

[51] Int. Cl.[3] ..... B02C 23/14

[52] U.S. Cl. ..... 241/20; 209/3; 209/17; 209/166; 75/97 A; 423/111

[58] Field of Search ..... 209/3, 2 P, 12 P, 166 P, 209/212 P, 17, 13; 241/20, 24; 75/97 A; 423/111

[56] References Cited

U.S. PATENT DOCUMENTS

| | | | |
|---|---|---|---|
| 1,931,921 | 10/1933 | Breerwood | 241/24 X |
| 2,942,792 | 6/1960 | Anderson | 241/24 X |
| 3,207,304 | 9/1965 | Thom | 309/167 X |
| 3,363,758 | 1/1968 | Cronberg | 209/166 |
| 3,441,131 | 4/1969 | Gebaver | 209/3 |
| 3,650,396 | 3/1972 | Gillespie | 209/12 X |
| 3,675,859 | 7/1972 | Mitchell | 241/20 |
| 4,070,273 | 1/1978 | Morey | 209/3 |
| 4,113,466 | 9/1978 | Weston | 209/166 X |
| 4,126,073 | 11/1978 | Cromwell | 241/24 X |
| 4,168,227 | 9/1979 | Polgaire | 209/166 |

FOREIGN PATENT DOCUMENTS

| | | | |
|---|---|---|---|
| 2827924 | 4/1979 | Fed. Rep. of Germany | 241/24 |

*Primary Examiner*—Robert Halper

*Attorney, Agent, or Firm*—Montague & Ross

[57] ABSTRACT

A process for the treatment of an aluminum-salt slag produced in the remelting of aluminum by the addition of salt to aluminum scrap wherein the aluminum salt slag is subjected to pressure and impact rolling to a thickness of about 0.2 mm to about 1 mm and the product is milled to an $X_{80}$ value of about 130 to 150 microns. The milled product is classified in a plurality of stages to recover therefrom a large-particle fraction consisting at least predominantly of aluminum particles, and a fine-particle fraction. The fine-particle fraction is subjected to flotation in at least one flotation stage to which a base is added in an amount of 0.04 to 0.4 g of the base per ton of the material subjected to flotation to bring the pH to between 10 and 11, whereupon a cation active collector of the formula $RO—(CH_2)_n—NH—(CH_2)_n—NH_2$ is added to recover an impurity-containing froth of low chloride level and a concentrate containing most of the chlorides of said slag.

10 Claims, 4 Drawing Figures

NOTES:
$R_m$ = MASS RECOVERY IN WT. % WITH RESPECT TO 100% FEED.
$R_a$ = SELECTIVE RECOVERY IN WT. % WITH RESPECT TO 100% FEED.
$c_c$ = CONCENTRATION OF VALUABLE MINERALS IN WT. % WITH RESPECT TO A FRACTION.

NOTES:
$R_m$ = MASS RECOVERY IN WT.% WITH RESPECT TO 100% FEED.
$R_a$ = SELECTIVE RECOVERY IN WT.% WITH RESPECT TO 100% FEED.
$c_c$ = CONCENTRATION OF VALUABLE MINERALS IN WT.% WITH RESPECT TO A FRACTION.

PROCESS FOR THE TREATMENT OF ALUMINUM-SALT SLAGS

FIELD OF THE INVENTION

The present invention relates to a process for the treatment of aluminum-salt slags for the recovery of aluminum and a recyclable salt product.

BACKGROUND OF THE INVENTION

In the production of aluminum bodies it is a common practice to utilize, as much as possible, aluminum scrap to reduce the quantity of raw materials required. Such scrap normally is associated with a relatively high proportion of various impurities which must be removed before the scrap aluminum forms a useful melt. The scrap aluminum is treated in aluminum remelting plants, generally in a rotary furnace, to remove these impurities.

To assist in the removal of the impurities, the common practice is to add slag-forming salts to the scrap aluminum in the furnace.

One part of the salt mixture is added to two parts of the aluminum scrap in the smelting furnace. The salt mixture generally comprises 25 to 30% by weight potassium chloride, 65 to 70% by weight sodium chloride, 2% by weight calcium fluoride ($CaF_2$) and traces of other chlorides, fluorides, sulfates and bromides.

Aside from acting as slag formers, the additive also controls the rheology of the melt.

Because of the remelting of aluminum scrap, large quantities of salt slags are obtained which can be constituted of 4% to 8% by weight aluminum metal, 18% to 20% by weight potassium chloride, 45% to 50% by weight sodium chloride and 22% and 33% by weight of water-soluble components.

The disposal of these slags with other wastes creates serious ecological problems since it can result in an increase in the salt concentration of ground water and, upon solubilization of the salts, an evolution of gases which are partially toxic and are noxious. The storage of these wastes in other ways, i.e. in subterranean caverns, has been found to be highly uneconomical.

Experiments have been carried out to treat aluminum salt slags to recover the aluminum and the salts.

For example, a solubilization process has been developed which involves high treatment cost and large energy expenditures. Other salt recovery processes, such as reverse osmosis, solubilization and freezing or chemical or thermal precipitation, have not proved to be practicable also because of their high energy costs and their environmental effects.

Efforts to carry out a separation by high voltage electrostatic precipitation techniques do not yield the desired results.

OBJECTS OF THE INVENTION

It is, therefore, the principal object of the present invention to provide an improved process for the recovery of aluminum and reusable salts from aluminum salt slags of the type produced in the remelting of aluminum scrap.

Another object of this invention is to provide a process for the treatment of aluminum salt slags obtained in the remelting of aluminum which is economically feasible, environmentally sound, and of low energy consumption.

Yet another object of the invention is to provide an improved process for the treatment of aluminum salt slags which will enable the recovery of aluminum and valuable salts, leaving as a residue a product which can be disposed of with other wastes, including household wastes, without problems.

Still a further object of our invention is to provide a process of the class described which is free from the disadvantages of earlier systems for the treatment of aluminum salt slags.

SUMMARY OF THE INVENTION

The present invention is based upon our discovery that aluminum salt slags contain a large number of mineral phases which, in large measure, are intergrown while the metallic aluminum is generally trapped somewhat less tightly in the mineral structure. According to the invention, therefore, the metallic aluminum is converted into a form which facilitates its inorganic separation and which enables the oxide, hydroxide, oxyhydrate and silicate components to be separated out from the slag collectively so that the sodium chloride and potassium chloride components of the slag can be recycled as slag-forming additives to the furnace.

More specifically, the slag is initially comminuted by pressure and impact effect and rolled out to a thickness of 1 to 0.2 mm, the rolled product being then milled with pressure and impact milling to an $X_{80}$ value of 130 to 150 microns.

This comminuted product is subjected to multi-stage particle-size separation or fractionation, i.e. classification, e.g. by sieving, air sifting or screening to recover a first fraction having a particle size of 300 to 500 microns and consisting of coarse aluminum particles and a fine particle fraction with a particle size less than 300 to 200 microns ($X_{80}$ value of 130 to 150 microns) which is subjected to foam flotation with cation-active coagulant or collecting agents which can be alkylether amines of the formula $RO—(CH_2)_n—NH_2$ or alkylether polyalkylene diamines of the formula $RO—(CH_2)_n—NH—(CH_2)_n—NH_2$ and salts thereof with organic and inorganic acids, e.g. the acetate or hydrochloride salts. R is a straight or branched chain saturated or unsaturated alkyl having 8 to 22 carbon atoms and mixtures thereof, while n can be 1 to 5, preferably 3. This collector is used in an amount of 500 to 2500 grams per ton of flotation-feed solids, preferably 1000 to 1500 grams per ton.

Before this agent is added to the flotation stage, it is preferred to treat the flotation stage with a base, such as a metal hydroxide, preferably an alkaline-earth metal hydroxide such as $C_a(OH)_2$ or $Mg(OH)_2$, in an amount of 0.04 to 0.4 g per ton (of the fine fraction) to bring the pH to a value of 10 to 11. After separating the nonchloride component in the foam product from the cell residue, the pure potassium chloride/sodium chloride concentrate in the latter is filtered and dried to form a salt concentrate which can be recycled to the flotation process or otherwise processed. The organic coagulating agent should be permitted to react with the flotation system for a period of 1 to 3 minutes.

An important aspect of the invention is the preparation of the slag to recover therefrom the large-grained aluminum particles with a particle size of 300 to 500 microns and a fine grained product with a particle size corresponding to an $X_{80}$ value of 130 to 150 microns in which the salt and the water soluble components are practically quantitatively present.

This requires the treatment of the slag by the comminution process described previously, i.e. the passage of the pieces of slag through a roll mill with a gap width of say 0.5 mm and thereafter through a ball mill. The slag pieces can also be subjected to similar effects in a rod or pin mill, i.e. subjected to such a combination of pressure, fraction and impact, as to comminute the slag and simultaneously cause the aluminum particles to flatten and assume the large particle configuration which enables their recovery in the manner described. Similar results can also be obtained with a pug mill which subjects the slag pieces to a combination of pressure and shear forces.

The milling stages not only break up the complex slag particles and flatten the aluminum trapped in the slag, but also appear to mechanically induce a separation of these flattened aluminum particles from the grains of mineral matter produced by the comminution, these grains consisting predominantly of the salts and water in soluble components of the slag.

The treatment converts the aluminum grain to platelets of 0.2 to 1.5 mm in thickness by the rolling and squeezing actions during the comminution so that these particles during air sifting, screening or sieving are easily recovered from the remainder of the particles.

The selective increase in the size of the aluminum components and transformation of the mineral matter to a fine particle component is thus an important feature of the invention since it allows the simple mechanical separation steps of air sifting, sieving or screening to separate these two components.

It should be noted that during the comminution treatment of the broken-up slags by the fine roll mill, the oxides, hydroxides and silicates are formed into small platelets with the salts acting as binders, these platelets being more difficult to separate from the aluminum without the second comminution step which is the milling operation mentioned previously following the rolling.

The second milling step applies pressure, fraction and impact to the mass which have little effect upon the aluminum platelets but readily comminute the oxide, hydroxide and silicate platelets to the fine grain products mentioned previously.

The comminuted product, substantially freed from the aluminum platelets, can be subjected to foam flotation in the described manner to recover 70 to 85% of the chlorides contained in the slag.

The removal of sodium chloride and potassium chloride is dependent upon the collector concentration which can be varied within a wide range.

The flotation process is effected at the preferred pH range of 10 to 11, established as described above, and the impurities in the salt component, such as corundum ($Al_2O_3$) and spinels are removed in the froth product, i.e. the foam.

In the separation of the aluminum particles from the comminuted product by air sifting, we prefer to make use first of an air stream with a velocity of 0.4 to 0.8 meters per second and to then subject the separated coarse product by a second air sifting with an air velocity between 2 and 4.5 meters per second with a sifting-air loading of 1 to 2 kg of solids per cubic meter of air. The fines recovered in the second sifting operation are recycled to the comminution stage or to one of the comminution steps. The coarse product obtained in the second air-sifting stage has an aluminum concentration of 94% by weight and represents a recovery of 50 to 70% of the aluminum of the slag.

The recovered aluminum in the large-size platelet form, can be smelted without further compaction.

The metallic aluminum can also be recovered by multistage sieving or screening. Since the aluminum salt slags from these continuous smelting processes differ in composition and mechanical characteristics (structure), the mineralogical composition of the particle sizes of the individual minerals will differ materially with the slags of different furnace charges. With the multi-stage screening of the present invention, an excellent aluminum separation can be obtained in spite of such variations.

The comminuted product is thus passed through or onto sieves of different-size apertures, preferably ranging from 2 to 0.3 mm.

The product retained on the 2 mm sieve generally is found to be 100% aluminum, the product retained on a 1 mm sieve being 90 to 95% pure aluminum, while the product retained on the 0.5 mm sieve is 50 to 90% pure aluminum. This last retained fraction can be recycled to the comminuting process.

The sieve-separation of aluminum will produce, depending upon the particle size of the aluminum, a product which may constitute 50 to 75% of the aluminum in the salt slag originally.

The fraction passing the 0.3 mm sieve can be subjected to flotation in the aforedescribed manner.

When the foam flotation is carried out with a cation-active collector, a portion of the potassium chloride is trapped therewith so that with increasing collector concentrations, there is a corresponding reduction in the KCl level in the liquid phase.

To avoid this (since the highest level of the chlorides should be retained in the liquid which is separated from the foam in a one-stage process), the invention provides that after the screening or air sifting, the fines with a particle size smaller than 200 to 250 microns ($X_{80}=130$ to 150 microns) is subjected first to a direct KCl flotation with a cation-active collector of the free fatty amine type or a salt thereof with inorganic or organic acids of the formula $$R'—NH_2 \text{ or } [R'—NH_3]_+.CH_3CO\bar{O} \text{ or } [R'—NH_3]_+.Cl^-$$

wherein R' is a straight or branched chain saturated or unsaturated alkyl of 8 to 22 carbon atoms or a mixture thereof. After separation of the foam product the liquor is recycled to the flotation process and the cell residue is subjected to further flotation.

The use of this direct KCl flotation approach allows a combination of direct KCl flotation with indirect NaCl flotation using two distinct collectors whose selectivities can be appropriately chosen so that the cell residue of the first stage can be separated from the flotation liquor before the next stage.

With the combined flotation process, i.e. the two stage flotation described above, 70 to 80% by weight of the total salts contained in the slag are recovered and the deposited wastes contain 20% by weight or less water-soluble chlorides.

To minimize the requirement of fresh liquor in the flotation process it is advantageous that froth be separated from the flotation and the cell residues are filtered and the filtered liquor is recycled to the corresponding flotation stage.

In spite of this recycling, flotation operations continuously lose liquor so that in each flotation stage fresh water must be introduced. This can be utilized for further reduction in the chloride content of the waste by treating the filtered substances from the first or second stage filtration to leach additional chlorides therefrom and by utilizing the chloride-containing water as the makeup water for the respective flotation stages. This additional step has been found to reduce the chloride content of the waste significantly below 20% by weight.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
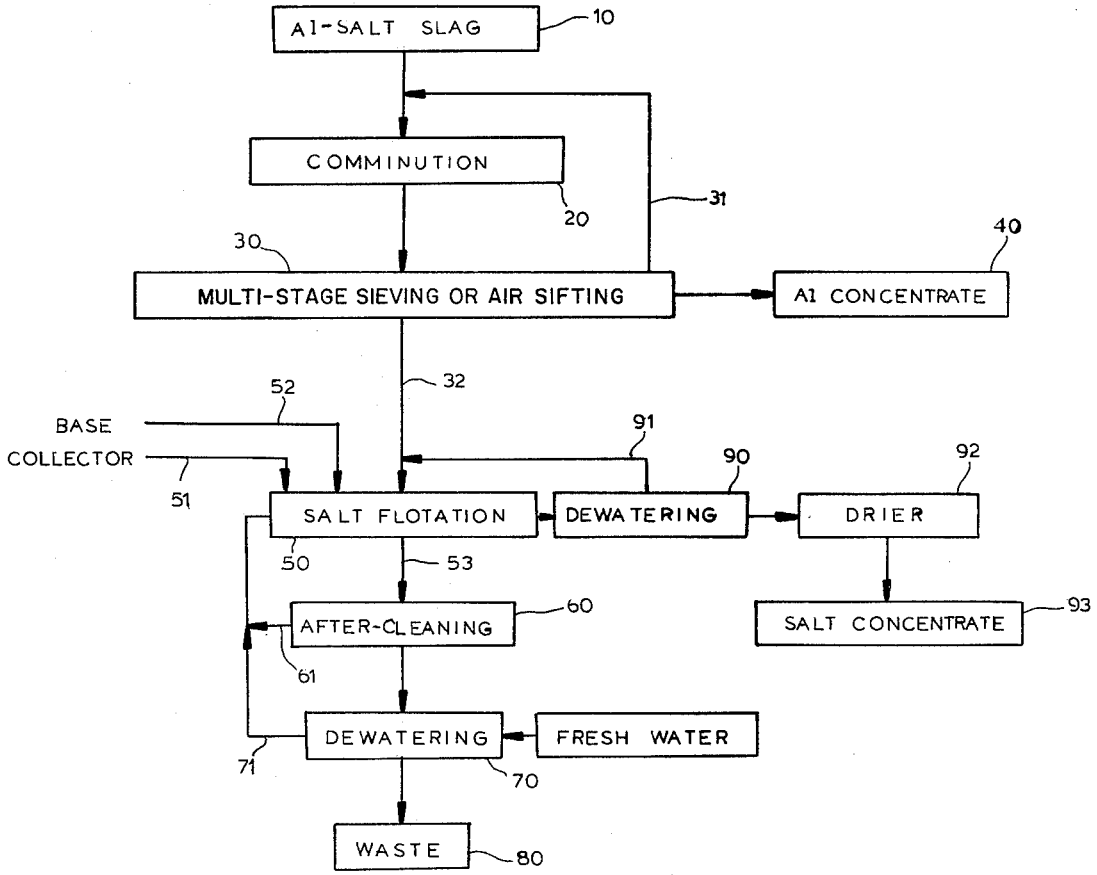
FIG. 1 is a flow diagram of the process of the present invention using a single stage flotation.
Figure 2:
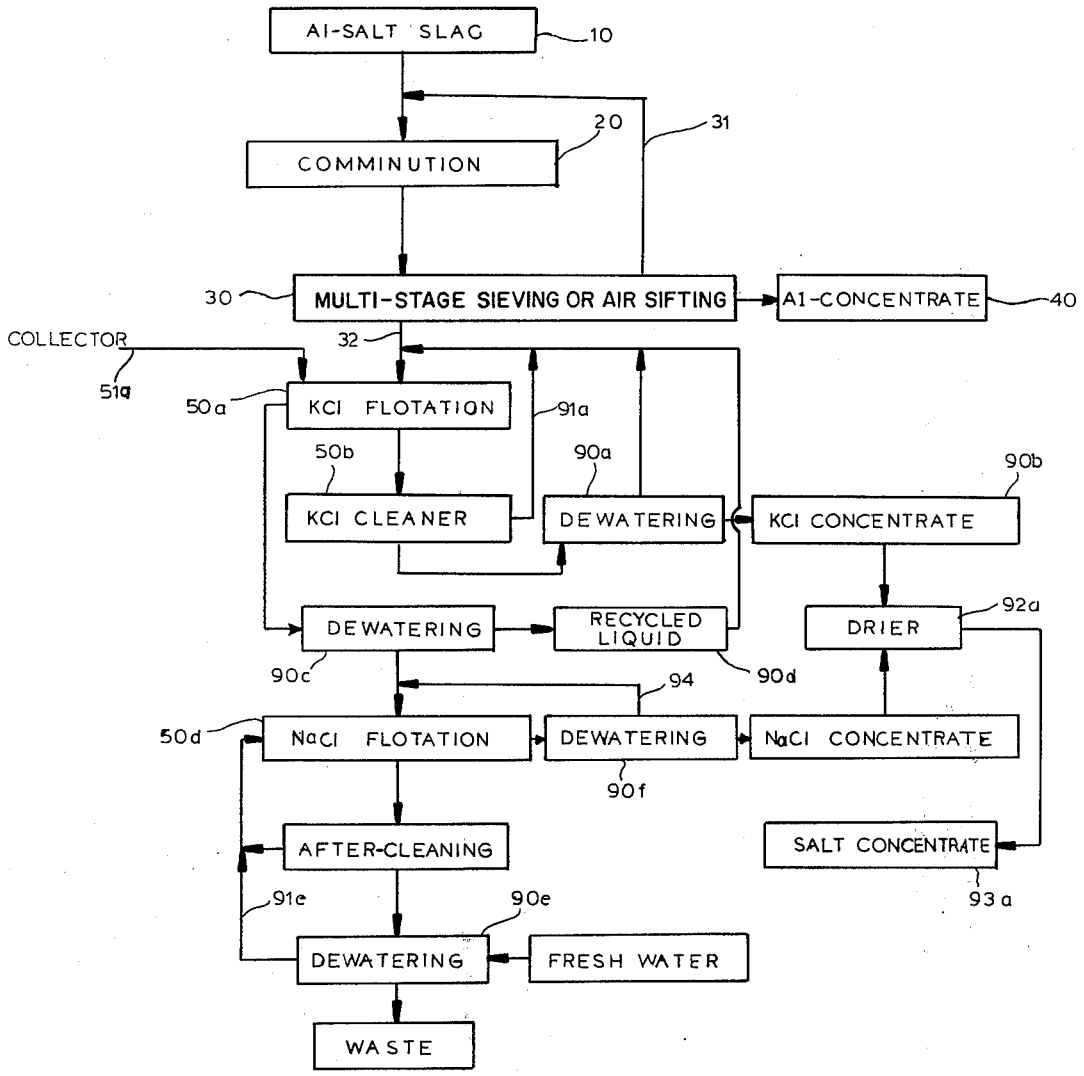
FIG. 2 is a flow diagram representing the process with a two stage flotation.

FIGS. 1 and 2 show flow diagrams for the treatment of aluminum salt slags according to the present invention. In the detailed examples the aluminum salt slag is understood to be available in pieces having maximum size of 20 cm and consisting essentially of 45 to 50% by weight sodium chloride, 17 to 20% by weight potassium chloride, 4 to 8.5% by weight aluminum and 20 to 25% by weight other minerals as described above.

In both processes, the mass of slag pieces, represented as the aluminum salt slag at 10, is subjected to multistage comminution and ultimate milling at 20, using jaw, impact or hammer mills for the initial comminution with the final or further comminution being effected in a roll mill followed by a ball mill or with the pin or rod mill or pug mill as described previously until the comminuted product at the end of stage 20 has an $X_{80}$ value of 130 to 150 microns. The comminuted product thus contains the aluminum in the form of thin platelets while the salts and impure minerals, corundum, spinels, other oxides, hydroxides and silicates, are separable therefrom by air sifting or screening.

The milled product of the slag comminuted in this manner can have the sieve analysis given in Table 1 below in which the $H_2O$ insoluble residue corresponds to the sum of the impure minerals in the form of oxides, hydroxides, silicates and the like.

TABLE 1

| | (All % given by weight) | | | | |
|---|---|---|---|---|---|
| Fraction | Mass % | NaCl % | KCl % | Aluminum % | $H_2O$ Insoluble % |
| +250 μm | 6.43 | 32.7 | 12.4 | 18.7 | 36.2 |
| +200 μm | 3.17 | 34.7 | 17.8 | 6.5 | 41.0 |
| +150 μm | 7.24 | 42.4 | 20.0 | 6.0 | 32.6 |
| +100 μm | 11.16 | 49.8 | 20.2 | 4.1 | 25.9 |

TABLE 1-continued

| | (All % given by weight) | | | | |
|---|---|---|---|---|---|
| Fraction | Mass % | NaCl % | KCl % | Aluminum % | $H_2O$ Insoluble % |
| −100 μm | 72.00 | 51.3 | 18.6 | 3.5 | 26.6 |
| Approximate Composition | | 48.8 | 18.5 | 4.8 | 28.1 |

In the next stage 30 the aluminum is mechanically separated from the remainder of the slag. As described, this can be done by multistage sieving or multistage air sifting.

In the multistage sieving step, the pure aluminum with a particle size greater than 500 microns is pure aluminum and is obtained as the aluminum concentrate 40, not having passed a corresponding sieve. The slag fraction of a particle size of 500 to 200 microns is recycled at 31 to the milling stage. In the multistage air sifting, the first sifting is carried out with an air velocity of 0.4 to 0.8 m per second. The fine product is supplied at 32 to the foam flotation state. The coarse product is subjected to air sifting in a second stage with air at a velocity of 2.5 to 0.5 m per second from the coarse fraction of which 90% of aluminum is obtained as the aluminum concentrate 40. Further purification of the aluminum can be carried out in after-sifting stages not shown. The fine component of the second air sifting stage is recycled to the comminution step 20 as represented at 31.

When the aluminum is not present in the slag with a particle size below 500 microns, at least 65% of the metallic aluminum can be recovered in this manner.

Figure 3:
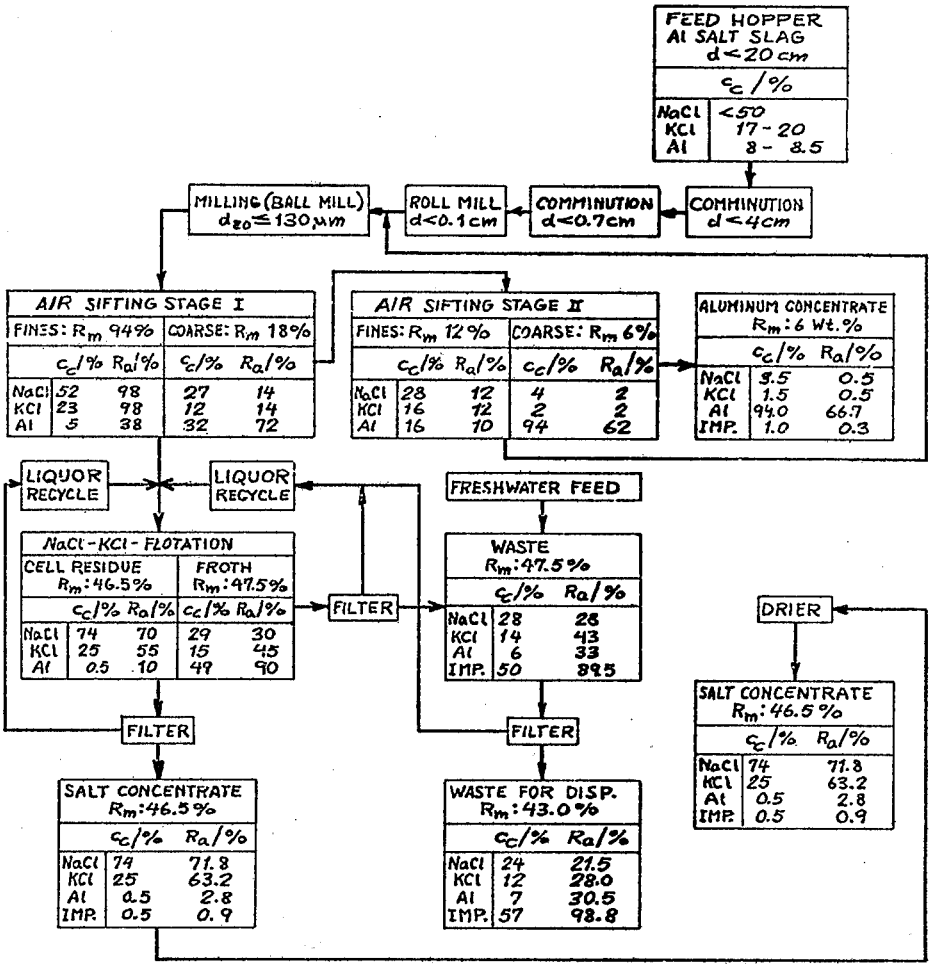
FIG. 3 is a diagram corresponding to the process of FIG. 1 but providing details of a specific example of the invention.

FIGS. 1 and 3 show the process of the present invention utilizing a combined NaCl-KCl flotation, i.e. a single stage flotation. To the flotation stage 50, a collector of the aforedescribed composition is added as represented at 51 preferably in an amount of 1500 g per ton of the salt treated. This collector is added in two to five aliquots during the flotation stage with the residence time of the collector being 1 to 3 minutes for each addition. The pH of the flotation stage is adjusted by the addition of a base, preferably calcium hydroxide, as represented at 52, to a pH value of 10 to 11.

The resulting froth of foam contains the impure minerals which contaminate the salt and this foam product can be recovered at 53 and subjected to after cleaning at 60 with the recovered liquor at 61 being recycled to the flotation stage. The froth residue is subjected to dewatering and contact with fresh water at 70, the fresh water constituting the makeup water for the flotation process and leaching residual salt from the foam product by being cycled to the flotation stage at 71. The waste recovered at 80 is nontoxic and can be disposed of with household wastes.

The cell residue of the flotation stage is filtered off with the filtrate being recycled to the flotation stage 91, this filtration constituting the dewatering represented at 90 of the salt concentrate. The salt concentrate is supplied to a dryer 92 and the dry salt concentrate is recovered at 93 for reuse in the slag-forming process.

Table 2 below shows the composition of the waste and the salt concentrate derived from the flotation-separated product.

TABLE 2

(All % by weight)

| Flotat. Product | % of Total | NaCl Content % | NaCl % of Total | KCl Content % | KCl % of Total | Alum. Metal Cont. % | Alum. Metal % of Total | $H_2O$ Insol. Residue Cont. % | $H_2O$ Insol. Residue % of Total |
|---|---|---|---|---|---|---|---|---|---|
| Waste | 42.6 | 33.5 | 23.4 | 13.46 | 42.55 | 2.09 | 67.93 | 50.7 | 90.1 |
| Salt Concentr. | 57.4 | 81.6 | 76.6 | 13.50 | 57.45 | 0.73 | 32.07 | 4.2 | 9.9 |
| | 100.0 | 61.1 | 100.0 | 13.49 | 100.00 | 1.31 | 100.00 | 24.0 | 100.0 |

The foregoing flotation results show the metal balance of a single stage flotation process using an alkyl ether amino acetate Mg-98A of Ashland Chemical Co., Minneapolis, Minn., at a pH 10.4 in an amount of 1500 g per ton added in four aliquots, the pH having been adjusted with calcium hydroxide and the waste having not been after cleaned or treated with fresh water. The salt concentrate contained 95.1% by weight chloride.

In a single stage flotation process as thus described, the salt concentrate has a chloride content of above 95% with a recovery of 70% of the chlorides from the comminuted product from which the aluminum had previously been separated, the waste containing up to 25% chloride, in extreme cases, 30% chloride after fresh water treatment.

Better flotation results are obtained when the collector is an alkyl ether propylene diamine, especially Hoe F 2468 or Hoe F 2640 of Farbwerke Hoechst AG, Frankfurt, Germany. This collector is added after adjustment of the pH to 10.5 with calcium hydroxide in an amount of 1000 g per ton in four aliquots with two minutes between each addition.

Table 3 shows balance for the aluminum as well as the chlorides utilizing the process. The salt concentrate contains about 99% by weight of the chlorides.

TABLE 3

(All % by weight)

| Product | Amt. % | Aluminum Content % | Aluminum % of Total | NaCl Content % | NaCl % of Total | KCl Content % | KCl % of Total | $H_2O$ Insol. % Content % | Residue % of Total |
|---|---|---|---|---|---|---|---|---|---|
| Aluminum Concentrate | 6.0 | 94.0 | 66.7 | 3.5 | 0.5 | 1.5 | 0.5 | 1.0 | 0.3 |
| Salt Concentrate | 46.5 | 0.5 | 2.8 | 74.0 | 71.8 | 25.0 | 63.2 | 0.5 | 0.9 |
| Waste | 43.0 | 6.0 | 30.5 | 24.0 | 21.5 | 12.0 | 28.0 | 58.0 | 98.8 |
| Recycled Liquor | 4.5 | — | — | 66.0 | 6.2 | 34.0 | 8.3 | — | — |
| | 100.0 | 8.45 | 100.0 | 47.9 | 100.0 | 18.4 | 100.0 | 25.4 | 100.0 |

Figure 4:
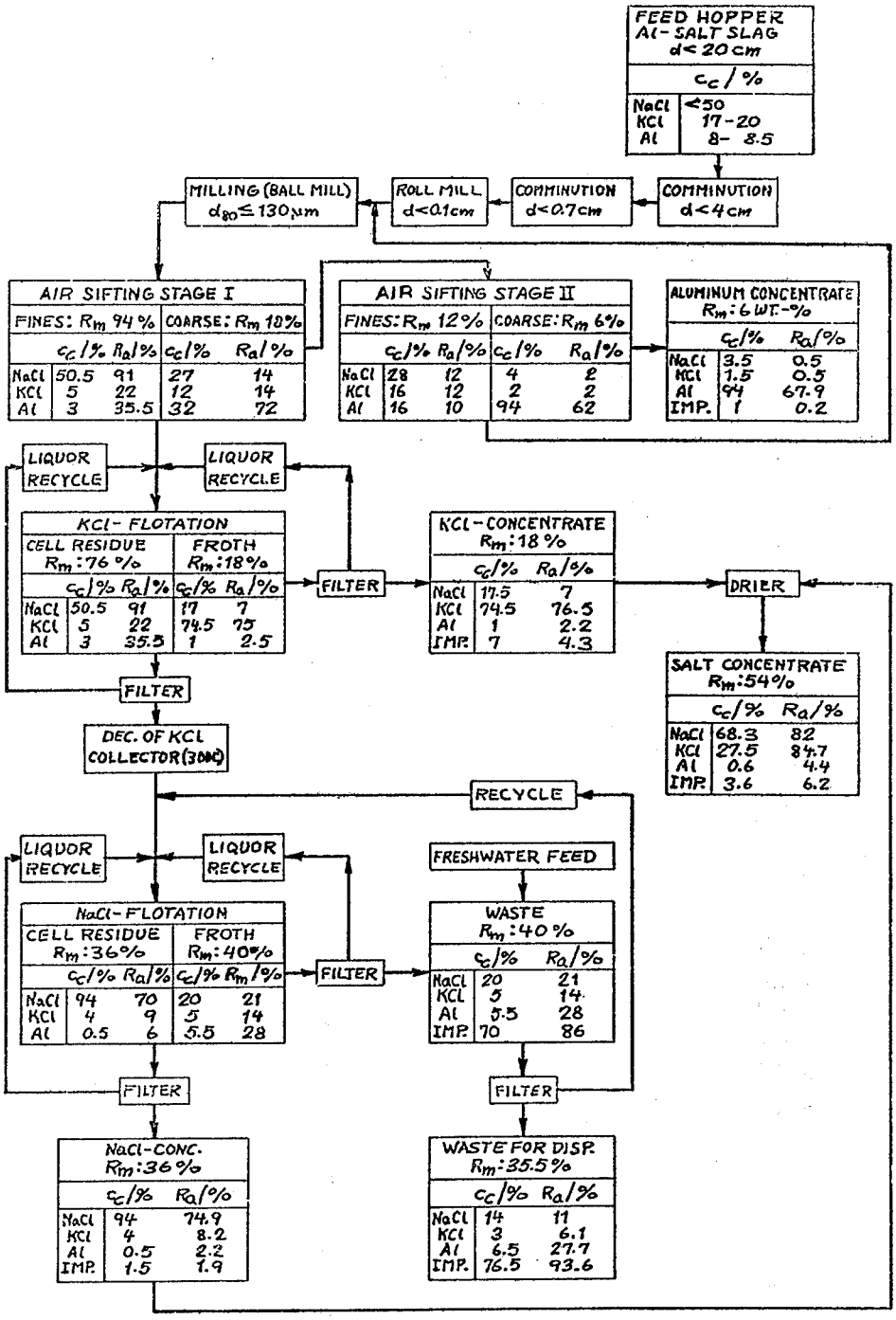
FIG. 4 represents the process detailed in FIG. 2 but with the values obtained in the specific examples, corresponding to the Tables of FIG. 3.

FIGS. 2 and 4 show an embodiment of the invention in which the fines of the first sifting stage (FIG. 4) or the product 32 passing the screen of the last screening stage (FIG. 2) are subjected first to a potassium chloride flotation at 50a. About 30 to 100 g per ton of the collector is added to this flotation stage at 51a and is permitted to act for about two minutes. The foam flotation is carried out at practically neutral conditions with a pH of 6 to 8 and the froth is filtered off at 50b with the liquor being recycled to the KCl flotation as represented at 91a.

This froth contains 70 to 80% by weight KCl, 15 to 20% NaCl, up to 1% by weight aluminum and 4 to 14% impurities. This froth can be subjected to after cleaning and ultimately is dewatered at 90a to recover the potassium chloride concentrate at 90b.

The cell residue of this flotation stage is dewatered at 90c and the liquor recycled at 90d to the flotation stage. The dewatered cell residue can be thermally treated in a dryer at 300° C. to decompose the KCl collector before this product is introduced into the sodium chloride flotation stage 50d to ensure that the KCl collector and the NaCl collector will not interfere with one another or detrimentally affect each other's selectivity. The cell residue of the KCl flotation with a second collector, used in an amount of about 1500 g per ton, is subjected to the flotation subsequent stage having been set at a pH 10.5 with calcium hydroxide. This collector is added at four aliquots spaced apart by two minutes each. The foam product is filtered off at 90e with the liquor being recycled at 91c to the flotation stage.

The flotation results of this two-stage process are represented in Table 4.

TABLE 4

| Flotat. Product | % of Total | NaCl Cont. % | NaCl % of Total | KCl Cont. % | KCl % of Total | Aluminum Cont. % | Aluminum % of Total | $H_2O$ Insol. Cont. % | Residue % of Total |
|---|---|---|---|---|---|---|---|---|---|
| KCl Concentrate | 19.2 | 19.6 | 7.2 | 72.1 | 76.2 | 0.9 | 5.6 | 7.3 | 5.5 |
| NaCl-Concentrate | 38.5 | 94.1 | 68.4 | 4.0 | 8.3 | 0.4 | 5.6 | 1.8 | 2.8 |
| Waste | 42.3 | 30.5 | 24.4 | 6.6 | 15.5 | 7.6 | 88.8 | 55.1 | 91.7 |

TABLE 4-continued

| Flotat. Product | % of Total | NaCl Cont. % | NaCl % of Total | KCl Cont. % | KCl % of Total | Aluminum Cont. % | Aluminum % of Total | $H_2O$ Insol. Cont. % | Residue % of Total |
|---|---|---|---|---|---|---|---|---|---|
| | 100.0 | 52.9 | 100.0 | 18.1 | 100.0 | 3.6 | 100.0 | 25.4 | 100.0 |

The foam product of the NaCl stage, which contains the impurities, can be aftercleaned as often as is desirable. The flotation results from a two-stage foam flotation with a simple one-stage aftercleaning are shown in Table 5.

TABLE 5

| Flotat. Product | % of Total | NaCl Cont. % | NaCl % of Total | KCl Cont. % | KCl % of Total | Aluminum Cont. % | Aluminum % of Total | $H_2O$ Insol. Cont. % | Residue % of Total |
|---|---|---|---|---|---|---|---|---|---|
| KCl Concentrate | 19.2 | 19.6 | 7.2 | 72.1 | 76.2 | 0.9 | 5.6 | 7.3 | 5.5 |
| NaCl-Concentrate | 38.5 | 94.1 | 68.4 | 4.0 | 8.3 | 0.9 | 5.6 | 1.8 | 2.8 |
| Middle Product | 11.1 | 62.9 | 13.2 | 22.2 | 13.8 | 1.7 | 5.6 | 13.2 | 5.9 |
| Waste | 31.2 | 18.9 | 11.2 | 1.0 | 1.7 | 9.6 | 83.2 | 69.9 | 85.8 |
| | 100.0 | 52.9 | 100.0 | 18.1 | 100.0 | 3.6 | 100.0 | 25.4 | 100.0 |

With a single cleaning of the waste, i.e. the foam product of the NaCl flotation, there is a reduction of the chloride content of more than 50% from the chloride level above 35% to a maximum of 20% chloride.

In these tests the 10 to 15% liquor loss during the filtration is made up by the addition of fresh water which is added to and then filtered from the waste, before being admixed to the sodium chloride flotation stage. The chloride content in the waste can thus be lowered to 15 to 20%, usually 15 to 17%. For the tests of example 4, the KCl flotation stage were carried out at neutral pH with primary fatty amine hydrochlorides as marketed under the name Armeen HTD by the firm Armour Hess. This collector is added in an amount of 100 g per ton and removes the KCl. The aftercleaning of the KCl concentrate is not reflected in Table 4.

The KCl concentrate contains 91.7% chloride. The filtered cell residue of the KCl stage is dispersed in a fresh liquor and brought to a pH of 10.5 with calcium hydroxide. The collector is here the water soluble preparation Hoe F 2468, namely, Hoe F 2640, which is added in an amount of 1500 g per ton in four aliquots with two minutes between the additions. The sodium chloride concentrate contains 98.4% chloride. The chloride recovery of the two stages is on the average of 80%. In the case of Table 4 the waste was not aftercleaned nor was it washed or treated with fresh water.

The concentrations and recoveries in the salt concentrate are the same as those given in Table 4 but the chloride content of the waste can be reduced by the aftercleaning. 13% chloride can be recycled as an intermediate to the flotation stage or aftercleaned in further stages. The number of aftercleaning stages is, of course, unlimited.

In the material balance represented by Tables 4 and 5, the afterwashing of the waste, namely, the froth of the sodium chloride flotation is not reflected. The cell residue of the sodium chloride flotation, rich in sodium chloride, is filtered off and the liquor recycled to the sodium chloride flotation.

The filter cake can be dried and mixed with dried potassium chloride concentrate at 93*a*. This mixture can serve as salt additive for the flux formation during the remelting of aluminum scrap.

FIGS. 3 and 4 show comparative results of the one-stage and two-stage processes (see also Table 5).

In the two-stage flotation of the above-described type, cationic active collectors of the free fatty amine class are used for the first stage so that the major part of the KCl is removed in the froth.

The subsequent treatment of the cell residue is effected in a manner similar or identical to the flotation of the single stage process, i.e. after the addition of a base to bring the flotation system to a pH between 10 and 11 prior to the addition of the cation active collector for this stage. When this flotation is effected subsequent to a KCl flotation, i.e. is an indirect NaCl flotation, the preferred collector is an alkyl ether polyalkylene diamine.

Investigations have shown that a further simplification of the process can be achieved by treating the fines resulting from screening or sifting and of a particle size with an $X_{80}$ value of 130 to 150 microns, initially by direct KCl flotation with a cation active collector of the alkyl ether polyalkylene monoamine type having the formula $R—O—(CH_2)_n—NH_2$ or its salts with organic or inorganic acids such as its acetate salt $]R—O(CH_2)_n—NH_3]_+.CH_3COO^-$ or its hydrochloride salt $[R—O(CH_2)_n—NH_3]_+.Cl^-$ at a concentration of 200 to 100 g of the collector per ton of solids. R is a straight or branched chain saturated or unsaturated alkyl having 6 to 12 carbon atoms or a mixture thereof and n is 1 to 5, preferably 3. Preferably, prior to the addition of this collector to the direct KCl flotation stage, the latter is brought to a pH of 7 to 9, advantageously by the addition of a base such as calcium hydroxide.

The KCl is recovered in the froth, i.e. as a foam product and after separation and, if desired, one or more aftercleaning steps, the foam product, usually after thickening, is subjected to flotation at the pH of 10 to 11 described earlier. The liquor decanted from the thickener is recycled to the KCl flotation stage.

This latter procedure can be carried out without the dewatering of the waste of the KCl flotation prior to the treatment of the cell residue by indirect NaCl flotation.

This is because the alkyl ether polyalkylene monoamine does not interfere with the selectivity of the alkyl ether polyalkylene diamine in the NaCl flotation stage. The elimination of the dewatering and drying of the KCl flotation cell residue results in a significant simplification and hence a major reduction in cost.

We claim:

1. A process for the treatment of an aluminum-salt slag containing NaCl and KCl, oxides and hydroxides produced in the remelting of aluminum by the addition of salt to the aluminum scrap, said process comprising the stages of:

(a) comminuting the aluminum-salt slag with pressure and impact and rolling the comminuted product to a thickness of about 0.2 mm to about 1 mm;

(b) milling the rolled product of step (a) to an $X_{80}$ value of about 130 to 150 microns to produce a milled product;

(c) classifying the milled product of step (b) in a plurality of stages to recover therefrom a large-particle fraction consisting at least predominantly of aluminum particles, and a fine-particle fraction containing NaCl and KCl;

(d) subjecting said fine-particle fraction to a high-salt-concentration flotation in at least one flotation stage to which a base is added in an amount of 0.04 to 0.4 g. of the base per ton of the material subjected to flotation to bring the pH of said one flotation stage to a pH value between 10 and 11, whereupon a cation active collector is added which is selected from the group which consists of compounds of the formula $RO—(CH_2)_n—NH—(CH_2)_n—NH_2$ and of the formula $RO—(CH_2)_n—NH_2$ wherein R is a straight or branched chain saturated or unsaturated alkyl having 8 to 22 carbon atoms or mixture thereof, and n is 1 to 5, or an organic or inorganic salt thereof, to recover an impurity-containing froth of low chloride level with oxides and hydroxides and a concentrate containing most of the chlorides of the salts including the KCl and NaCl, of said slag;

(e) recycling flotation liquor from the products obtained in step (d) to the flotation stage thereof; and (f) dewatering said concentrate of step (d).

2. The process defined in claim 1 wherein the milled product of step (b) is classified in step (c) by multistage screening on screens having opening sizes from 2 to 0.3 mm, the fine fraction passing the 0.3 mm screen, the aluminum being recovered as fractions from screens retaining a particle size above 0.5 mm, and the fraction retained on a 0.5 mm screen being recycled to the milling step (b).

3. The process defined in claim 1 wherein the classification in step (c) is carried out first in a zigzag air stream with a velocity of 0.5 to 0.8 m per second to recover a coarse fraction, said coarse fraction being subjected to a second air sifting with an air speed of 2 to 4.5 m per second with each air sifting being effected with a solids charge of 1 to 2 kg per cubic meter of air, fines from the second sifting being recycled to the milling in step (b) while fines from the first sifting form said fine fraction, a coarse component of the second sifting being recovered as an aluminum concentrate.

4. The process defined in claim 1, claim 2 or claim 3 wherein the fine fraction obtained in step (c) in a particle size range with an $X_{80}$ value of 130 to 150 microns is initially subjected to direct KCl flotation with a cation active collector which consists of $R—O—(CH_2)_n—NH_2$ or a hydrochloride or acetate salt or a mixture thereof, thereby producing a froth and a cell residue, said cell residue being thereafter processed as recited in step (d).

5. The method defined in claim 1 wherein the flotation yields a froth, further comprising the step of separating the froth forming a cell residue by filtration, thereby recovering a liquor, and recycling said liquor to the flotation from which it was derived.

6. The process defined in claim 5 wherein said froth is washed with fresh water, further comprising the step of feeding the water with which the froth was washed to the respective flotation as makeup water for loss of liquor therefrom.

7. The process defined in claim 1 wherein said collector is added in an amount of 500 to 2500 g per ton of solids in the flotation stage.

8. The process defined in claim 4 wherein the collector added in the first flotation stage is present in an amount of substantially 50 to 100 g per ton of the solids therein while the collector in the second flotation stage is added in an amount of 1000 to 1500 g per ton of the solids treated therein.

9. The process defined in claim 1, claim 2 or claim 3, wherein the fine fraction from step (c) is subjected to a direct KCl flotation with a cation active collector having the formula $R'—O—(CH_2)_n—NH_2$ or an acetate or hydrochloride thereof in a collector concentration of 200 to 1000 g of the collector per ton of solids in the KCl flotation stage, R' being a straight or branched chain saturated or unsaturated alkyl of 6 to 12 carbon atoms or mixtures thereof and, the KCl flotation system being brought to a pH of 7 to 9 prior to the addition of the collector thereto, thereby producing a froth containing KCl.

10. The process defined in claim 9 wherein the froth is separated from a cell residue which is subjected to further flotation as defined in step (d).

* * * * *